US006622415B1

(12) United States Patent
Canaday et al.

(10) Patent No.: US 6,622,415 B1
(45) Date of Patent: Sep. 23, 2003

(54) COMPACT AND SELF-CONTAINED ADJUSTABLE SIGHT ASSEMBLY

(75) Inventors: Michael M. Canaday, King George, VA (US); Mark R. Whalen, Clarkston, MI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/198,673

(22) Filed: Jul. 19, 2002

(51) Int. Cl.[7] ..... F41G 1/46
(52) U.S. Cl. ..... 42/140; 42/112; 42/126
(58) Field of Search ..... 42/140, 126, 136–139

(56) References Cited

U.S. PATENT DOCUMENTS

| | | | | | |
|---|---|---|---|---|---|
| 974,914 | A | * | 11/1910 | Norman | 187/305 |
| 1,407,208 | A | * | 2/1922 | McDougal | 42/137 |
| 2,112,268 | A | * | 3/1938 | Burton | 42/138 |
| 2,343,802 | A | | 3/1944 | Rodney | 33/257 |
| 2,511,245 | A | | 6/1950 | Caster | 33/256 |
| 3,495,339 | A | * | 2/1970 | Elliason | 42/137 |
| 3,748,744 | A | | 7/1973 | McClenahan | 33/257 |
| 3,925,902 | A | | 12/1975 | Gevers | 33/257 |
| 3,979,848 | A | | 9/1976 | Ackerman, Jr. | 42/15 |
| 4,208,821 | A | | 6/1980 | Power | 42/15 |
| 4,461,087 | A | | 7/1984 | Norman | 33/249 |
| 4,651,432 | A | * | 3/1987 | Bornancini | 42/133 |
| 4,691,442 | A | * | 9/1987 | Center | 42/140 |
| 4,977,676 | A | | 12/1990 | Toupin | 42/254 |
| 5,533,292 | A | | 7/1996 | Swan | 42/100 |
| 5,606,818 | A | * | 3/1997 | Hardee | 42/124 |
| 5,680,725 | A | * | 10/1997 | Bell | 42/127 |
| 6,000,667 | A | * | 12/1999 | Isbell et al. | 248/201 |
| 6,418,657 | B1 | * | 7/2002 | Brown | 42/124 |
| 6,481,146 | B2 | * | 11/2002 | Carrier, III | 42/136 |

* cited by examiner

*Primary Examiner*—Michael J. Carone
*Assistant Examiner*—D Buckley
(74) *Attorney, Agent, or Firm*—Matthew J. Bussan, Esq.; James B. Bechtel, Esq.; Peter J. Van Bergen, Esq.

(57) ABSTRACT

An adjustable sight assembly for attachment to a firearm is provided. A base with a recessed portion has a plate that loosely fits within the recessed portion. A windage adjustment assembly cooperating with the base and a first end of the plate i) effects side-to-side movement of the plate within the recessed portion of the base, and ii) defines a pivotal coupling of the plate to the base at the first end thereof. A second end of the plate moves along an arc when the plate is pivoted about the first end thereof. An elevation adjustment assembly cooperating with the base and the second end of the plate effects elevation of the plate's second end. A sight is pivotally coupled to the plate such that the sight can lie against the plate when not in use and can be rotated approximately 90° to extend vertically from the plate when in use.

15 Claims, 3 Drawing Sheets

COMPACT AND SELF-CONTAINED ADJUSTABLE SIGHT ASSEMBLY

ORIGIN OF THE INVENTION

The invention described herein was made in the performance of official duties by employees of the Department of the Navy and may be manufactured, used, licensed by or for the Government for any governmental purpose without payment of any royalties thereon.

1. Field of the Invention

The invention relates generally to sights used on firearms, and more particularly to a compact and self-contained sight assembly having both windage and elevation adjustment capability.

2. Background of the Invention

Most of today's sophisticated hand-held firearms use a scope as the primary means for sighting. In most instances, the scope is attachable to the firearm. For example, the M4 series of carbine, as well as a number of the M16 series of rifles, have a Picatinny mounting rail (i.e, MIL-STD-1913 rail) serving as the mounting point for the scope. If the scope breaks, some other type of sight must be employed. While the inclusion of an extra scope is a possibility this requires the carrying of an extra piece of hardware into the field. Further, the user has to remove one scope and mount the replacement before the firearm can be used effectively. The time it takes for this repair can be life threatening in certain situations.

SUMMARY OF THE INVENTION

Accordingly, it is an object of the present invention to provide a back-up sight that can be permanently or semi-permanently mounted on a firearm.

Another object of the present invention is to provide a back-up sight that can be adjusted in terms of windage and elevation.

Still another object of the present invention to provide a back-up sight that can be mounted on a firearm while not impairing use of the firearm's scope.

Still another object of the present invention is to provide a fully adjustable, compact and self-contained backup sight that can be mounted on a firearm while not impairing use of the firearm's attachable scope.

Other objects and advantages of the present invention will become more obvious hereinafter in the specification and drawings.

In accordance with the present invention, an adjustable sight assembly for attachment to a firearm is provided. A base, rigidly attachable to a firearm, defines a recessed portion. A plate having a first end and a second end is fitted loosely within the recessed portion of the base. A windage adjustment assembly cooperating with the base and the first end of the plate effects side-to-side movement of the plate within the recessed portion of the base. The windage adjustment assembly further defines a pivotal coupling of the plate to the base at the first end thereof. As a result, the second end of the plate can move along an arc when the plate is pivoted about the first end thereof. An elevation adjustment assembly cooperating with the base and the second end of the plate effects elevation of the plate's second end thereby pivoting the plate about the first end thereof. A sight is pivotally coupled to the plate such that the sight can lie against the plate when not in use and can be rotated approximately 90° to extend vertically from the plate when in use.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
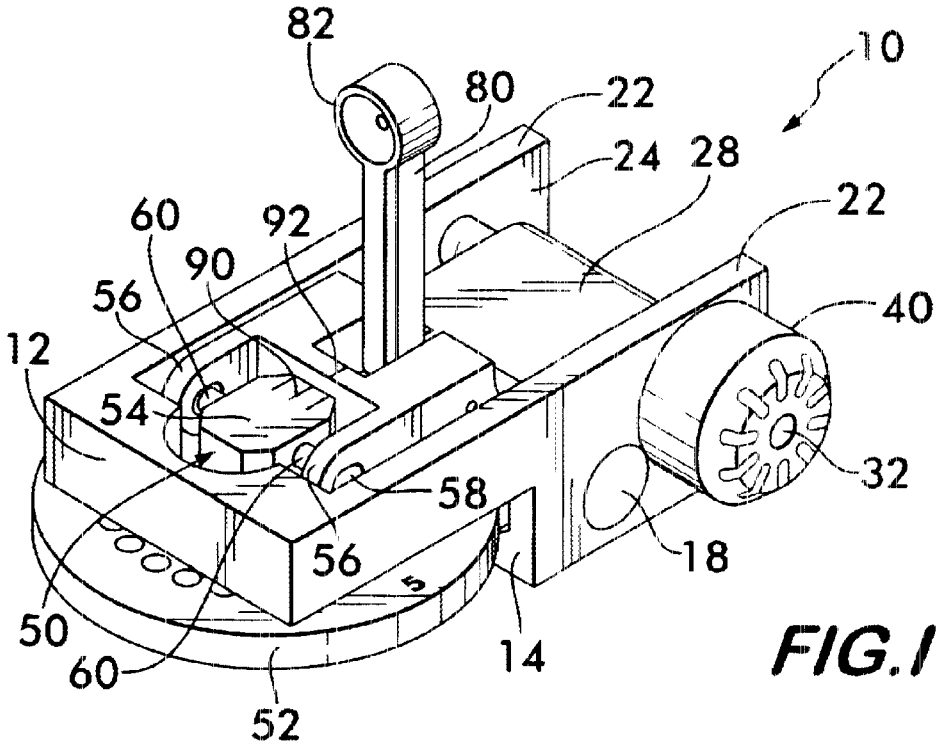
FIG. 1 is a perspective view of the adjustable sight assembly in accordance with the present invention shown with the sight in its "flipped up" position.

Referring now to the drawings, simultaneous reference will be made to FIGS. 1–3 where the adjustable sight assembly is illustrated in an isolated perspective view, a side view with the sight assembly being mounted on a firearm 100, and an isolated exploded view, respectively. In each of these views, the adjustable sight assembly is referenced generally by numeral 10.

Figure 2:
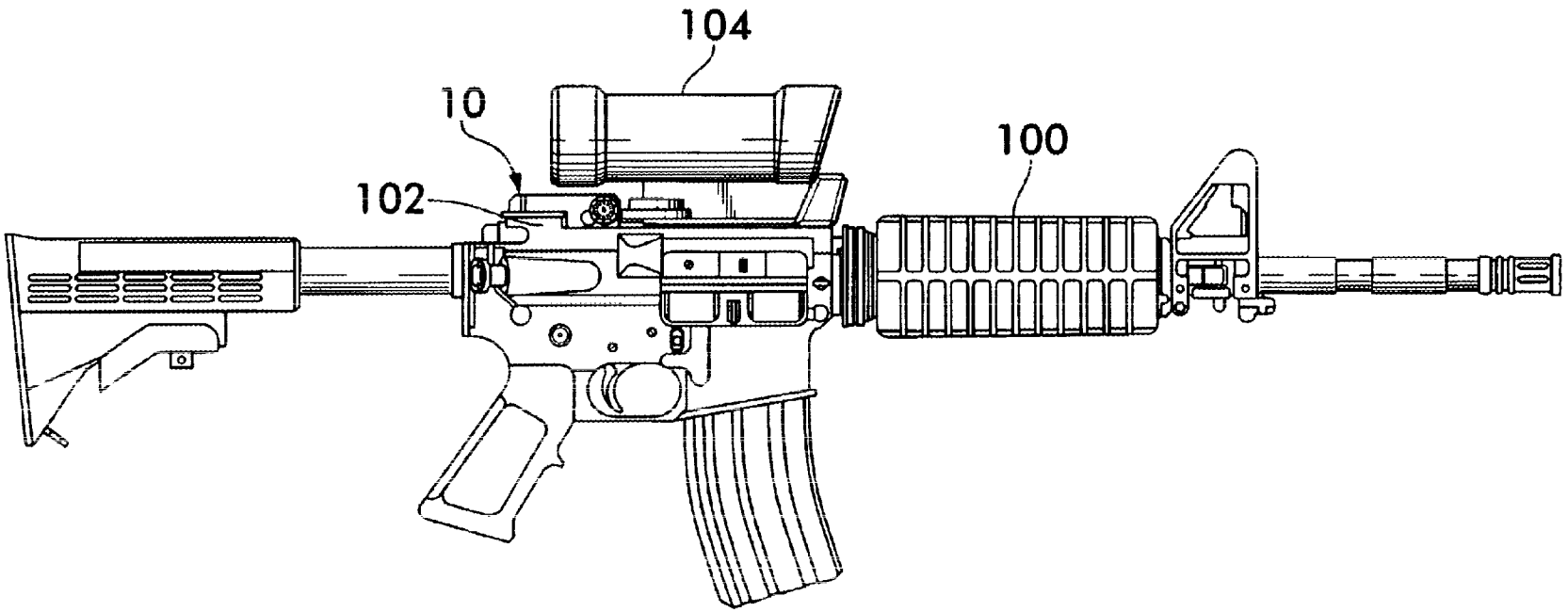
FIG. 2 is a side view of the sight assembly mounted on a Picatinny rail of a firearm with the sight in its "flipped down" position.
Figure 3:
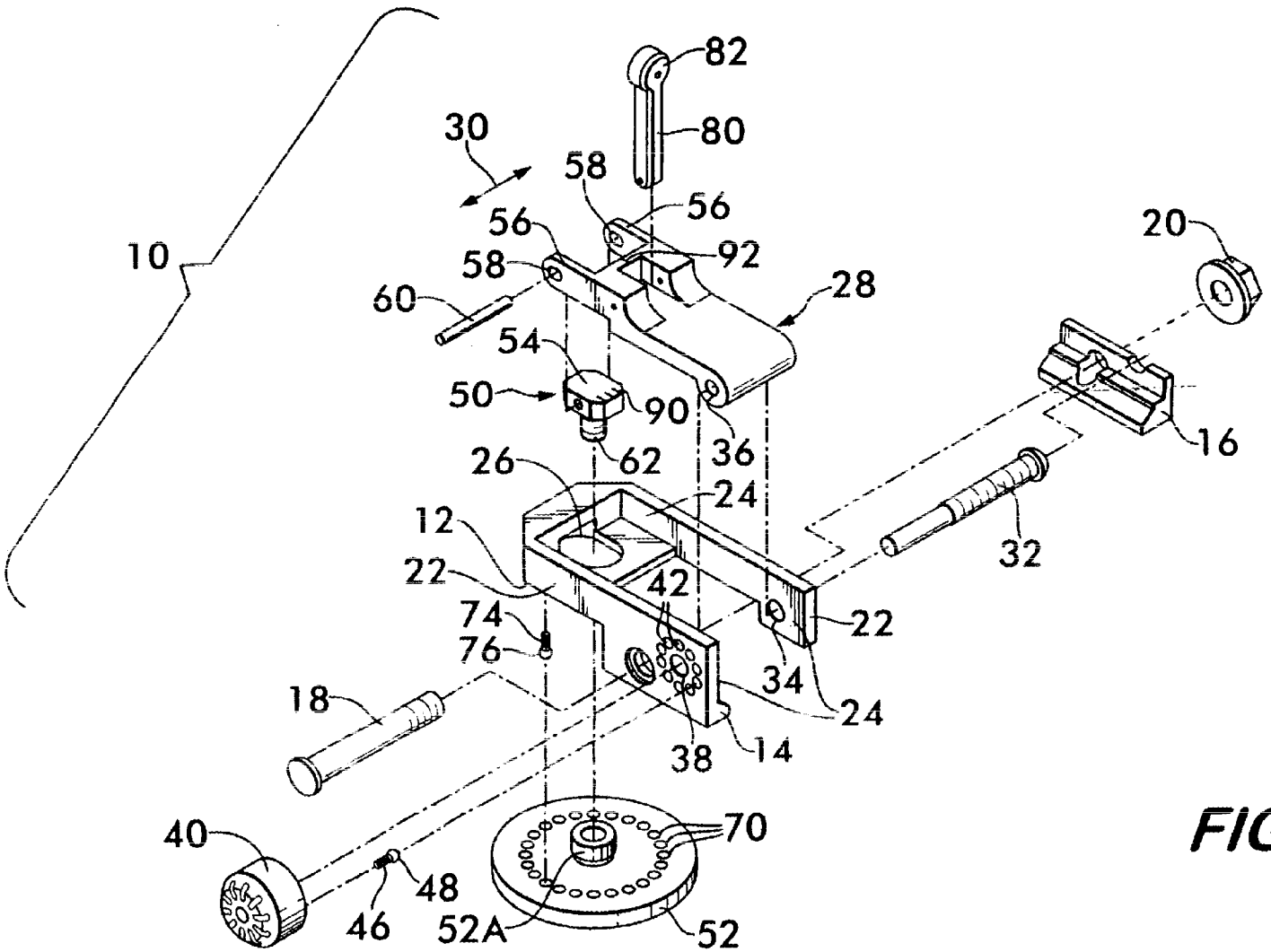
FIG. 3 is an exploded view of the sight assembly.

FIG. 2 illustrates sight assembly 10 in its "flipped down" position attached to the Picatinny rail 102 of firearm 100 (e.g., an M4 series carbine) beneath and behind the firearm's attachable scope 104. In this way, sight assembly 10 does not interfere with the use of scope 104, but is available for use (as will be explained further below) if scope 104 fails and is removed. However, it is to be understood that this particular placement and mounting is purely exemplary and is not a limitation of the present invention. For example, sight assembly 10 could be permanently integrated into the design of the firearm as opposed to being attachable to a mounting rail thereof as illustrated.

Sight assembly 10 has a base 12 configured for mounting to rail 102. For example, in the illustrated embodiment, the mounting portion of base 12 includes a main body having an integral clamping jaw 14, a movable clamping jaw 16, and a clamp screw 18 passing through holes in jaws 14 and 16. Screw 18 is threadably engaged with a nut 20 which, when tightened, draws jaw 16 towards jaw 14 for capturing a mounting rail (e.g., rail 102) therebetween in a manner well understood in the art.

The main body portion of base 12 includes an outer frame 22 defining a recessed portion 24 with a hole 26 formed in recessed portion 24. A swing arm or plate 28, dimensioned to fully and loosely fit in recessed portion 24, is coupled to base 12 by means of an assembly that i) provides for side-to-side movement (i.e., windage adjustment as indicated by two-headed arrow 30 in FIG. 3) of plate 28 within recessed portion 24, and ii) provides for rotation of plate 28 about the assembly that couples plate 28 to base 12. More specifically, a screw 32 passes through a hole 34 in one side of frame 22, threadably engages a threaded sleeve 36 formed in plate 28, and passes through a hole 38 (aligned with hole 34) in the other side of frame 22. Attached to the end of screw 32 passing through hole 38 is a knob 40 that will be used to turn screw 32. Such attachment can be made, for example, by use of a set screw (not shown), by bonding, by press-fit, or by any other means known in the art. With the combination of screw 32 and knob 40 engaged by frame 22 such that only rotational movement thereof is permitted, turning of screw 32 causes plate 28 to move side-to-side within recessed portion 24.

Figure 4:
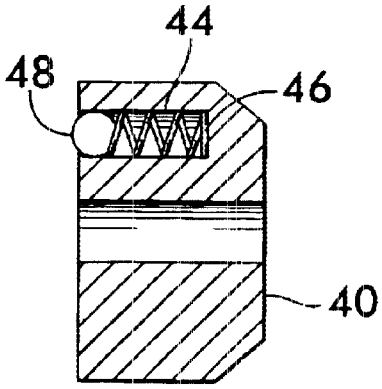
FIG. 4 is a cross-sectional view of the windage adjustment knob equipped with a spring-loaded detent mechanism.

If it is desired to bring about side-to-side movement 30 in known fixed increments, knob 40 can be equipped with a spring-loaded detent mechanism that cooperates with evenly spaced indentations 42 formed in frame 22 opposing knob 40. As illustrated in FIG. 4, the spring-loaded detent mechanism can be fitted in a sleeve 44 formed in knob 40. This mechanism can include a spring 46 and a ball detent 48 with spring 46 biasing ball detent 48 towards frame 22 for engagement in one of holes 42 as knob 40 is turned clockwise or counter clockwise.

As mentioned above, plate 28 can be rotated about screw 32 in an arc. The mechanism for facilitating such elevation movement of plate 28 includes an elevation screw 50 coupled to plate 28 and a thumbwheel 52 threadably engaging screw 50. More specifically, screw 50 includes a head 54 positioned between and loosely fitting between opposing arms 56 of plate 28. Each of arms 56 has a slot or slotted hole 58 formed therein/therethrough for loosely receiving a pin 60 protruding laterally from head 54. Note that the present invention could also function using a single arm/slot/pin combination. However, the use of opposing arms/slots/pins as illustrated is preferred for purposes of balancing loads on pins 60 when plate 28 is raised/lowered.

Elevation screw 50 also includes a threaded portion 62 that extends through hole 26 in base 12. Thumbwheel 52 threadably engages threaded portion 62. Thumbwheel 52 is sized to have a diameter that is greater than base 12. In this way, thumbwheel 52 is accessible for rotational movement from either side of frame 22. Thumbwheel 52 is coupled to base 12 in such a way that only rotational movement thereof is possible. For example, thumbwheel 52 can incorporate an annular flange 52A that cooperates with the perimeter of hole 26 in recessed portion 24 so that thumbwheel 52 is essentially captured by base 12. Since screw 50 is coupled to plate 28 and since only rotational movement of thumbwheel 52 is permissible, rotational movement (either clockwise or counterclockwise) of thumbwheel 52 results in the raising or lowering of screw 50. The elevation of screw 50 controls the arcing movement of plate 28 about screw 32.

Figure 5:
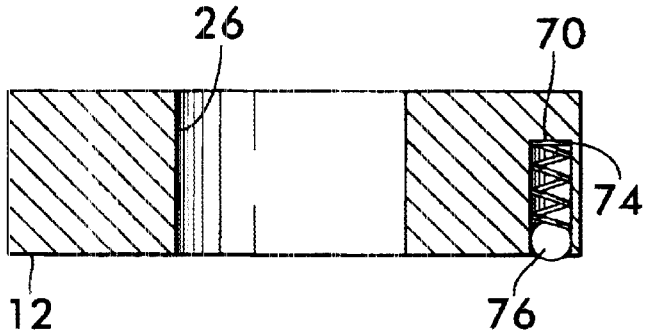
FIG. 5 is a cross-sectional view of the sight assembly's base taken along line 5—5 in FIG. 3 illustrating the base equipped with a spring-loaded detent mechanism for cooperation with the sight assembly's elevation thumbwheel.

If it is desired to bring about the elevation movement of plate 28 is known in fixed increments, base 12 can be equipped with a spring-loaded detent mechanism that cooperates with evenly spaced indentations or holes 70 formed in thumbwheel 52. As illustrated in FIG. 5, the spring-loaded detent mechanism can be fitted in a sleeve 72 formed in base 12. This mechanism can include a spring 74 and a ball detent 76 with spring 74 biasing ball detent 76 towards thumbwheel 52 for engagement in one of holes 70 as thumbwheel 52 is rotated clockwise or counter clockwise.

In accordance with the construction described above, side-to-side movement of plate 28 is effected by turning of knob 40. Arcing elevation movement of plate 28 is effected by rotation of thumbwheel 52. (Note that arcing elevation movement of plate 28 results in very small corresponding side-to-side movement of plate 28 as plate 28 is rotated about screw 32. However, the amount of resulting side-to-side movement is negligible in terms of using the present invention for sighting a target.) Accordingly, a sight coupled to plate 28 can be adjusted in terms of windage and elevation. In the present invention, the sight is an arm 80 pivotally coupled to plate 28 by means of a pin (not shown) or other means known in the art. At the outboard end of arm 80 is an eye aperture 82, the construction of which is well understood in the art.

For purpose of providing a compact design, plate 28 is configured so that plate 28 and arm 80/aperture 82 can be fully contained within the confines of base 12 when arm 80/aperture 82 are pivoted to lie against plate 28 as illustrated in FIG. 2. Then, when needed, arm 80/aperture 82 are rotated up approximately 90° to the position shown in FIG. 1. Windage and elevation adjustments are then made as necessary.

Indicia indicative of the amount of windage and elevation movement can be included on sight assembly 10. For example, windage travel of plate 28 can be indicated by tick marks 90 on head 54 (which remains stationary during side-to-side movement of plate 28) relative to a benchmark 92 on plate 28. Elevation travel of plate 28 can be indicated by numbers (e.g., indicative of angular elevation) on thumbwheel 52 placed on the outside edge or face thereof.

The advantages of the present invention are numerous. The sight assembly is compact for attachment to a firearm's rail at the same time that the firearm's scope is attached thereto without interfering with the scope's operation. However, if the scope should fail, a user need only remove the scope and flip up the sight (aperture). This will eliminate the need for the user to carry a back-up scope and greatly reduce the time required to recover from a scope failure. The sight assembly is fully self-contained to include both windage and elevation adjustment capability.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. An adjustable sight assembly for attachment to a firearm, comprising:

a base rigidly attachable to a firearm, said base defining a recessed portion;

a plate having a first end and a second end, said plate fitting loosely within said recessed portion of said base;

a windage adjustment assembly cooperating with said base and said first end of said plate for effecting side-to-side movement of said plate within said recessed portion of said base, said windage adjustment assembly further defining a pivotal coupling of said plate to said base at said first end wherein said second end of said plate moves along an arc when said plate is pivoted about said first end;

an elevation adjustment assembly cooperating with said base and said second end of said plate for effecting elevation of said second end of said plate along said arc by pivoting said plate about said first end thereof; and a sight pivotally coupled to said plate wherein said sight can lie against said plate when not in use and can be rotated approximately 90° to extend vertically from said plate when in use.

2. An adjustable sight assembly as in claim 1 wherein said plate and said sight can lie fully within said recessed portion of said base when said sight lies against said plate.

3. An adjustable sight assembly as in claim 1 wherein said windage adjustment assembly is indexed to bring about said side-to-side movement in fixed increments.

4. An adjustable sight assembly as in claim 1 wherein said elevation adjustment assembly is indexed to bring about said elevation in fixed increments.

5. An adjustable sight assembly as in claim 1 wherein said base includes a clamping portion for rigid attachment to an accessory mounting rail of the firearm.

6. An adjustable sight assembly for attachment to a firearm, comprising:

a base rigidly attachable to a firearm, said base defining a recessed portion;

a plate having a first end and a second end, said first end defining a threaded sleeve and said second end defining spaced-apart opposing arms, each of said arms having a slot formed therein, said plate fitting loosely within said recessed portion of said base;

a windage adjustment screw in threaded engagement with said threaded sleeve and coupled to said base for effecting side-to-side movement of said plate within said recessed portion of said base when said windage adjustment screw is turned, said windage adjustment screw further defining a pivotal coupling of said plate to said base at said first end wherein said second end of said plate moves along an arc when said plate is pivoted about said first end;

a post assembly having a head portion loosely fitted, between said arms and having a threaded portion extending from said head portion and through said base, said head portion having at least one pin extending therefrom for loose engagement in one said slot of said arms;

a thumbwheel threadably engaging said threaded portion of said post assembly, said thumbwheel engaged by said base wherein movement of said thumbwheel is limited to rotation thereof such that said rotation results in longitudinal movement of said post assembly for effecting elevation of said second end of said plate along said arc by pivoting said plate about said first end thereof; and a sight pivotally coupled to said plate wherein said sight can lie against said plate when not in use and can be rotated approximately 90° to extend vertically from said plate when in use.

7. An adjustable sight assembly as in claim 6 wherein said plate is configured such that said sight can lie fully within said recessed portion of said base when said sight lies against said plate.

8. An adjustable sight assembly as in claim 6 further comprising means coupled between said base and said windage adjustment screw for causing said side-to-side movement to occur in fixed increments when said windage adjustment screw is turned.

9. An adjustable sight assembly as in claim 6 further comprising means coupled between said base and said thumbwheel for causing said elevation to occur in fixed increments when said thumbwheel is rotated.

10. An adjustable sight assembly as in claim 6 wherein said base includes a clamping portion for rigid attachment to an accessory mounting rail of the firearm.

11. An adjustable sight assembly for attachment to a firearm, comprising:

a base rigidly attachable to a firearm, said base defining a recessed portion;

a plate having a first end and a second end, said first end defining a threaded sleeve and said second end defining spaced-apart opposing arms, each of said arms having a slot formed therein, said plate fitting loosely within said recessed portion of said base;

a windage adjustment screw in threaded engagement with said threaded sleeve and coupled to said base such that movement of said windage adjustment screw is limited to incremental turning thereof, said windage adjustment screw effecting side-to-side movement of said plate within said recessed portion of said base when said windage adjustment screw experiences said incremental turning, said windage adjustment screw further defining a pivotal coupling of said plate to said base at said first end wherein said second end of said plate moves along an arc when said plate is pivoted about said first end;

a post assembly having a head portion loosely fitted between said arms and having a threaded portion extending from said head portion and through said base, said head portion having at least one pin extending therefrom for loose engagement in one said slot of said arms;

a thumbwheel threadably engaging said threaded portion of said post assembly, said thumbwheel engaged by said base wherein movement of said thumbwheel is limited to incremental rotation thereof such that said incremental rotation results in longitudinal movement of said post assembly for effecting elevation of said second end of said plate along said arc by pivoting said plate about said first end thereof; and a sight pivotally coupled to said plate wherein said sight can lie against said plate when not in use and can be rotated approximately 90° to extend vertically from said plate when in use.

12. An adjustable sight assembly as in claim 11 wherein said plate is configured such that said sight can lie fully within said recessed portion of said base when said sight lies against said plate.

13. An adjustable sight assembly as in claim 11 further comprising means coupled between said base and said windage adjustment screw for effecting said incremental turning.

14. An adjustable sight assembly as in claim 11 further comprising means coupled between said base and said thumbwheel for effecting said incremental rotation.

15. An adjustable sight assembly as in claim 11 wherein said base includes a clamping portion for rigid attachment to an accessory mounting rail of the firearm.

* * * * *